US009523169B2

(12) United States Patent
Sawford et al.

(10) Patent No.: US 9,523,169 B2
(45) Date of Patent: Dec. 20, 2016

(54) CLEANING APPARATUS AND METHOD

(71) Applicant: Xeros Limited, Rotherham (GB)

(72) Inventors: Michael David Sawford, Rotherham (GB); Simon Paul Wells, Rotherham (GB)

(73) Assignee: Xeros Limited, Rotherham (GB)

( * ) Notice: Subject to any disclaimer, the term of this patent is extended or adjusted under 35 U.S.C. 154(b) by 181 days.

(21) Appl. No.: 14/550,359

(22) Filed: Nov. 21, 2014

(65) Prior Publication Data

US 2015/0152585 A1 Jun. 4, 2015

(30) Foreign Application Priority Data

Nov. 25, 2013 (GB) ..... 1320784.0

(51) Int. Cl.

| | |
|---|---|
| ***C11D 3/00*** | (2006.01) |
| ***D06F 35/00*** | (2006.01) |
| ***D06F 39/08*** | (2006.01) |
| *D06F 39/02* | (2006.01) |
| *D06F 39/12* | (2006.01) |
| *D06F 37/06* | (2006.01) |

(52) U.S. Cl.

CPC ..... *D06F 35/00* (2013.01); *D06F 35/006* (2013.01); *D06F 39/083* (2013.01); *D06F 37/06* (2013.01); *D06F 39/02* (2013.01); *D06F 39/12* (2013.01)

(58) Field of Classification Search

CPC ..... D06F 39/02; D06F 35/00; D06F 39/026; D06F 39/083; D06F 35/006; D06F 37/06; D06F 39/12

USPC ..... 8/137; 68/13 R

See application file for complete search history.

(56) References Cited

U.S. PATENT DOCUMENTS

| | | | |
|---|---|---|---|
| 2,970,464 | A | 2/1961 | Toma |
| 3,321,843 | A | 5/1967 | Taran et al. |
| 3,333,344 | A | 8/1967 | Loewen |
| 3,647,354 | A | 3/1972 | Loeb |

(Continued)

FOREIGN PATENT DOCUMENTS

| | | | |
|---|---|---|---|
| CA | 1284407 | C | 5/1991 |
| CN | 2789299 | Y | 6/2006 |

(Continued)

OTHER PUBLICATIONS

U.S. Appl. No. 14/412,100, Xeros Ltd.

(Continued)

*Primary Examiner* — Eric Golightly

(74) *Attorney, Agent, or Firm* — Clark & Elbing LLP

(57) ABSTRACT

The present invention provides a cleaning apparatus for cleaning at least one soiled substrate with a multiplicity of solid particles, the apparatus comprising: an external casing defining the external perimeter of the apparatus, said external casing defining at least an upper internal volume and a lower internal volume; a perforate drum arranged in the upper internal volume and configured for rotation about a horizontal axis, for agitation of the at least one soiled substrate during a cleaning process; a partition sealingly dividing the upper internal volume from the lower internal volume, the partition including a collecting region configured to collect and retain wash liquor and solid particles of said multiplicity of solid particles released from the drum during a cleaning process; a recirculating arrangement configured to transfer particles of said multiplicity of solid particles from said collecting region to said drum.

33 Claims, 2 Drawing Sheets

(56) References Cited

U.S. PATENT DOCUMENTS

| | | | |
|---|---|---|---|
| 3,650,673 | A | 3/1972 | Ehner |
| 3,805,406 | A | 4/1974 | Castonoli |
| 4,055,248 | A | 10/1977 | Marsan |
| 4,130,392 | A | 12/1978 | Diehl et al. |
| 4,188,807 | A | 2/1980 | Graf et al. |
| 4,374,443 | A | 2/1983 | Mosell |
| 4,434,067 | A | 2/1984 | Malone et al. |
| 4,493,783 | A | 1/1985 | Su et al. |
| 4,575,887 | A | 3/1986 | Viramontes |
| 4,655,952 | A | 4/1987 | Mesmer et al. |
| 4,750,227 | A | 6/1988 | Hopkins et al. |
| 4,801,333 | A | 1/1989 | Mosell |
| 4,809,854 | A | 3/1989 | Tomaszek |
| 4,839,969 | A | 6/1989 | Hahn |
| 4,951,366 | A | 8/1990 | Geller |
| 4,978,619 | A | 12/1990 | Kajiwara et al. |
| 5,245,722 | A | 9/1993 | Dameron |
| 5,305,533 | A | 4/1994 | Alexander et al. |
| 5,468,175 | A | 11/1995 | Nilen |
| 5,475,992 | A | 12/1995 | Wiegert |
| 5,503,840 | A | 4/1996 | Jacobson et al. |
| 5,547,476 | A | 8/1996 | Siklosi et al. |
| 5,601,480 | A | 2/1997 | Nilen |
| 5,605,491 | A | 2/1997 | Yam et al. |
| 5,667,431 | A | 9/1997 | Mortin |
| 5,804,548 | A | 9/1998 | Davis |
| 5,925,195 | A | 7/1999 | King et al. |
| 5,980,620 | A | 11/1999 | Brodie et al. |
| 5,993,839 | A | 11/1999 | Mixon |
| 6,235,705 | B1 | 5/2001 | Zembrodt et al. |
| 6,348,441 | B1 | 2/2002 | Aiken, III et al. |
| 6,448,212 | B1 | 9/2002 | Holderbaum et al. |
| 7,070,489 | B2 | 7/2006 | Rogmark |
| 7,097,715 | B1 | 8/2006 | Racette et al. |
| 7,481,893 | B2 | 1/2009 | Motson et al. |
| 7,498,294 | B2 | 3/2009 | Konno et al. |
| 8,959,961 | B2 | 2/2015 | Jenkins et al. |
| 8,974,545 | B2 | 3/2015 | Burkinshaw et al. |
| 9,017,423 | B2 | 4/2015 | Burkinshaw et al. |
| 9,121,000 | B2 | 9/2015 | Burkinshaw et al. |
| 9,127,882 | B2 | 9/2015 | Jenkins et al. |
| 9,297,107 | B2 | 3/2016 | Jenkins |
| 9,315,766 | B2 | 4/2016 | He et al. |
| 9,404,210 | B2 | 8/2016 | He et al. |
| 9,410,278 | B2 | 8/2016 | He et al. |
| 2002/0010300 | A1 | 1/2002 | Mimoun |
| 2002/0039976 | A1 | 4/2002 | Sebillotte-Arnaud et al. |
| 2002/0058595 | A1 | 5/2002 | Kaiser |
| 2003/0110580 | A1 | 6/2003 | Burkinshaw et al. |
| 2003/0134759 | A1 | 7/2003 | Geary et al. |
| 2004/0171515 | A1 | 9/2004 | Hamers et al. |
| 2004/0266641 | A1 | 12/2004 | Gentschev et al. |
| 2005/0148479 | A1 | 7/2005 | Barthel et al. |
| 2005/0153865 | A1 | 7/2005 | Detering et al. |
| 2005/0183206 | A1 | 8/2005 | Brown et al. |
| 2005/0183208 | A1 | 8/2005 | Scheper et al. |
| 2005/0204477 | A1 | 9/2005 | Casella et al. |
| 2006/0189506 | A1 | 8/2006 | Muller et al. |
| 2006/0287212 | A1 | 12/2006 | Sommer et al. |
| 2007/0151312 | A1 | 7/2007 | Bruce et al. |
| 2007/0270327 | A1 | 11/2007 | Beck et al. |
| 2008/0090746 | A1 | 4/2008 | Penninger |
| 2008/0223406 | A1 | 9/2008 | Lindqvist et al. |
| 2008/0306183 | A1 | 12/2008 | Leukel et al. |
| 2009/0090138 | A1 | 4/2009 | Wang |
| 2009/0186795 | A1 | 7/2009 | Feenstra et al. |
| 2009/0217461 | A1 | 9/2009 | Burkinshaw et al. |
| 2009/0276966 | A1 | 11/2009 | Mette et al. |
| 2010/0281928 | A1 | 11/2010 | Martin |
| 2011/0296628 | A1 | 12/2011 | Jenkins et al. |
| 2012/0048299 | A1 | 3/2012 | Jenkins et al. |
| 2012/0111359 | A1 | 5/2012 | Mueller et al. |
| 2012/0284931 | A1 | 11/2012 | Jenkins et al. |
| 2012/0304400 | A1 | 12/2012 | Jenkins et al. |
| 2013/0061404 | A1 | 3/2013 | Jenkins |
| 2013/0167882 | A1 | 7/2013 | Burkinshaw et al. |
| 2013/0276242 | A1 | 10/2013 | Jenkins et al. |
| 2013/0281345 | A1 | 10/2013 | Burkinshaw et al. |
| 2013/0283542 | A1 | 10/2013 | Jenkins et al. |
| 2013/0305560 | A1 | 11/2013 | Jenkins et al. |
| 2013/0340487 | A1 | 12/2013 | Yin et al. |
| 2014/0123402 | A1 | 5/2014 | He et al. |
| 2014/0137340 | A1 | 5/2014 | Burkinshaw et al. |
| 2014/0189961 | A1 | 7/2014 | He et al. |
| 2014/0201929 | A1 | 7/2014 | He et al. |
| 2014/0283314 | A1 | 9/2014 | He et al. |
| 2014/0317860 | A1 | 10/2014 | He et al. |
| 2015/0027173 | A1 | 1/2015 | Wu et al. |
| 2015/0096128 | A1 | 4/2015 | Sawford et al. |
| 2015/0096129 | A1 | 4/2015 | Sawford et al. |
| 2015/0128358 | A1 | 5/2015 | Wells et al. |
| 2015/0148278 | A1 | 5/2015 | Burkinshaw et al. |
| 2015/0152357 | A1 | 6/2015 | Abercrombie et al. |
| 2015/0175945 | A1 | 6/2015 | Waddon et al. |
| 2015/0252511 | A1 | 9/2015 | Roberts et al. |
| 2015/0344824 | A1 | 12/2015 | Burkinshaw et al. |
| 2016/0032522 | A1 | 2/2016 | Steele |
| 2016/0040260 | A1 | 2/2016 | Steele |
| 2016/0122932 | A1 | 5/2016 | Wells et al. |
| 2016/0122936 | A1 | 5/2016 | Wells et al. |
| 2016/0195409 | A1 | 7/2016 | Goldberg et al. |
| 2016/0197998 | A1 | 7/2016 | Carleo |
| 2016/0251602 | A1 | 9/2016 | Steele et al. |
| 2016/0251603 | A1 | 9/2016 | Steele et al. |
| 2016/0251795 | A1 | 9/2016 | Wells et al. |

FOREIGN PATENT DOCUMENTS

| | | | |
|---|---|---|---|
| CN | 101886321 | A | 11/2010 |
| CN | 102061588 | A | 5/2011 |
| CN | 102061589 | A | 5/2011 |
| CN | 202401272 | U | 8/2012 |
| CN | 202500017 | U | 10/2012 |
| CN | 202543635 | U | 11/2012 |
| DE | 1900002 | A1 | 7/1970 |
| DE | 3527724 | A1 | 2/1987 |
| DE | 3803195 | A1 | 8/1989 |
| DE | 19505921 | A1 | 8/1996 |
| DE | 10247289 | A1 | 4/2004 |
| DE | 102008009462 | A1 | 8/2009 |
| DE | 102009046170 | A1 | 5/2011 |
| EP | 0090372 | A1 | 10/1983 |
| EP | 0171215 | A1 | 2/1986 |
| EP | 0807463 | A2 | 11/1997 |
| EP | 1371718 | A1 | 12/2003 |
| FR | 2525645 | A1 | 10/1983 |
| GB | 1018318.4 | | 1/1966 |
| GB | 1256064 | A | 12/1971 |
| GB | 1297316 | A | 11/1972 |
| GB | 1379742 | A | 1/1975 |
| GB | 2249104 | A | 4/1992 |
| GB | 2302553 | A | 1/1997 |
| GB | 2365648 | A | 2/2002 |
| GB | 2456407 | A | 7/2009 |
| GB | 2473224 | A | 3/2011 |
| JP | S59-48078 | A | 3/1984 |
| JP | H01285188 | A | 11/1989 |
| JP | H0257295 | A | 2/1990 |
| JP | H03-146094 | B2 | 6/1991 |
| JP | H04105633 | | 4/1992 |
| JP | H04241165 | A | 8/1992 |
| JP | H06240297 | A | 8/1994 |
| JP | 03146094 | B2 | 3/2001 |
| JP | 2004238602 | A | 8/2004 |
| JP | 4241165 | B2 | 3/2009 |
| WO | WO-98/37270 | A1 | 8/1998 |
| WO | WO-99/40251 | A1 | 8/1999 |
| WO | WO-00/37540 | A1 | 6/2000 |
| WO | WO-00/77153 | A1 | 12/2000 |
| WO | WO-02/42403 | A1 | 5/2002 |
| WO | WO-03/054128 | A1 | 7/2003 |
| WO | WO-2004/066970 | A1 | 8/2004 |
| WO | WO-2006/020789 | A1 | 2/2006 |
| WO | WO-2006/040539 | A1 | 4/2006 |

(56) References Cited

FOREIGN PATENT DOCUMENTS

| | | | |
|---|---|---|---|
| WO | WO-2007/070520 | A1 | 6/2007 |
| WO | WO-2007/128962 | A1 | 11/2007 |
| WO | WO-2008/132456 | A1 | 11/2008 |
| WO | WO-2009/021919 | A2 | 2/2009 |
| WO | WO-2009/112296 | A1 | 9/2009 |
| WO | WO-2009/134018 | A2 | 11/2009 |
| WO | WO-2010/046473 | A1 | 4/2010 |
| WO | WO-2010/094959 | A1 | 8/2010 |
| WO | WO-2010/128337 | A2 | 11/2010 |
| WO | WO-2010/133837 | A1 | 11/2010 |
| WO | WO-2010/139689 | A1 | 12/2010 |
| WO | WO-2011/015429 | A2 | 2/2011 |
| WO | WO-2011/051140 | A1 | 5/2011 |
| WO | WO-2011/064581 | A1 | 6/2011 |
| WO | WO-2011/098815 | A1 | 8/2011 |
| WO | WO-2011/128676 | A1 | 10/2011 |
| WO | WO-2011/128680 | A2 | 10/2011 |
| WO | WO-2012/035342 | A1 | 3/2012 |
| WO | WO-2012/035343 | A1 | 3/2012 |
| WO | WO-2012/056252 | A2 | 5/2012 |
| WO | WO-2012/084619 | A1 | 6/2012 |
| WO | WO-2012/095677 | A2 | 7/2012 |
| WO | WO-2012/098408 | A2 | 7/2012 |
| WO | WO-2012/104861 | A1 | 8/2012 |
| WO | WO-2014/006424 | A1 | 1/2014 |
| WO | WO-2014/006425 | A1 | 1/2014 |

OTHER PUBLICATIONS

U.S. Appl. No. 14/412,298, Xeros Ltd.
U.S. Appl. No. 14/505,964, Xeros Ltd.
U.S. Appl. No. 14/505,978, Xeros Ltd.
U.S. Appl. No. 14/537,314, Xeros Ltd.
U.S. Appl. No. 14/577,285, Xeros Ltd.
U.S. Appl. No. 14/588,500, Xeros Ltd.
"Aqua Ball Set", <http://www.auravita.com/products/AURA/TAPR10610.asp>, Aug. 14, 2006 (3 pages).
"Capture Carpet Cleaning Kit", <http://www.basichomeshopping.com/CaptureCarpetCleanerKit.html>, Aug. 11, 2005 (4 pages).
"Capture Carpet Cleaning Kit", <http://www.domesticsale.com/Classifieds.15175.html>, Aug. 11, 2005 (1 page).
Michalon et al., "Enzyme coupling method on calibrated nylon spheres: application to the selective trypsinization of histones in chromatin," Biochem Biophys Res Commun. 167(1):9-15 (1990).
Search Report for Application No. GB1320784.0, mailed on Mar. 20, 2014 (3 pages).
International Search Report for International Application No. PCT/GB2014/053474 mailed Jan. 14, 2015 (11 pages).

CLEANING APPARATUS AND METHOD

FIELD OF THE INVENTION

The present invention relates to a cleaning apparatus that employs a solid particulate material for cleaning soiled substrates. In operation, the apparatus facilitates the use of only limited quantities of energy, water and detergent. The invention preferably relates to a cleaning apparatus which can have a cleaning volume for cleaning at least one soiled substrate wherein the cleaning apparatus is adapted so that the accumulation of fluids to form a body of fluid within the cleaning volume is substantially prevented. The invention relates to a cleaning apparatus wherein a partition sealingly divides an upper internal volume from a lower internal volume. The partition can define a collecting volume for collecting and retaining the solid particulate material. The lower internal volume can be maintained free from any water or wash liquor.

BACKGROUND TO THE INVENTION

Aqueous cleaning processes are a mainstay of conventional domestic and industrial textile fabric cleaning methods. On the assumption that the desired level of cleaning is achieved, the efficacy of such conventional processes is usually characterised by their levels of consumption of energy, water and detergent. In general, the lower the consumption requirements with regard to these three components, the more efficient the washing process is deemed. The downstream effect of reduced water and detergent consumption can also be significant, as this minimises the need for disposal of aqueous effluent, which is both extremely costly and detrimental to the environment.

Such washing processes involve aqueous submersion of fabrics followed by soil removal, aqueous soil suspension, and water rinsing. In general, within practical limits, the higher the level of energy (or temperature), water and detergent which is used, the better the cleaning. One key issue, however, concerns water consumption, as this sets the energy requirements (in order to heat the wash water), and the detergent dosage (to achieve the desired detergent concentration). In addition, the water usage level defines the mechanical action of the process on the fabric, which is another important performance parameter; this is the agitation of the cloth surface during washing, which plays a key role in releasing embedded soil. In aqueous processes, such mechanical action is provided by the water usage level in combination with the drum design for any particular washing machine. In general terms, it is found that the higher the water level in the drum, the better the mechanical action. Hence, there is a dichotomy created by the desire to improve overall process efficiency (i.e. reduce energy, water and detergent consumption), and the need for efficient mechanical action in the wash.

Various different approaches to the development of new cleaning technologies have been reported in the prior art, including methods which rely on electrolytic cleaning or plasma cleaning, in addition to approaches which are based on ozone technology, ultrasonic technology or steam technology. Thus, for example, WO2009/021919 teaches a fabric cleaning and disinfection process which utilises UV-produced ozone along with plasma. An alternative technology involves cold water washing in the presence of specified enzymes, whilst a further approach which is particularly favoured relies on air-wash technology and, for example, is disclosed in US2009/0090138. In addition, various carbon dioxide cleaning technologies have been developed, such as the methods using ester additives and dense phase gas treatments which are described in U.S. Pat. No. 7,481,893 and US2008/0223406, although such methods generally find greater applicability in the field of dry cleaning. Many of these technologies are, however, technically very complex.

In the light of the challenges which are associated with aqueous washing processes, the present applicants have previously devised a new approach to the problem that allows the deficiencies demonstrated by the methods of the prior art to be mitigated or overcome. The method which is provided eliminates the requirement for the use of large volumes of water, but is still capable of providing an efficient means of cleaning and stain removal, whilst also yielding economic and environmental benefits.

Thus, in WO2007/128962 there is disclosed a method and formulation for cleaning a soiled substrate, the method comprising the treatment of the moistened substrate with a formulation comprising a multiplicity of polymeric particles, wherein the formulation is free of organic solvents. The substrate may be wetted so as to achieve a substrate to water ratio of between 1:0.1 to 1:5 w/w, and optionally, the formulation additionally comprises at least one cleaning material, which typically comprises a surfactant, which most preferably has detergent properties. The substrate may comprise a textile fibre. The polymeric particles may, for example, comprise particles of polyamides, polyesters, polyalkenes, polyurethanes or their copolymers, a particular example being nylon beads.

The use of this cleaning method, however, presents a requirement for the nylon beads to be efficiently separated from the cleaned substrate at the conclusion of the cleaning operation, and this issue was initially addressed in WO2010/094959, which provides a novel design of cleaning apparatus requiring the use of two internal drums capable of independent rotation, and which finds application in both industrial and domestic cleaning processes.

With a view to providing a simpler, more economical means for addressing the problem of efficient separation of the cleaning beads from the substrate at the conclusion of the cleaning process, however, a further apparatus is disclosed in WO2011/064581. The apparatus of WO2011/064581, which finds application in both industrial and domestic cleaning processes, comprises a perforated drum and a removable outer drum skin which is adapted to prevent the ingress or egress of fluids and solid particulate matter from the interior of the drum. The cleaning method requires attachment of the outer skin to the drum during a first wash cycle, after which the skin is removed prior to operating a second wash cycle, following which the cleaned substrate is removed from the drum.

The apparatus and method of WO2011/064581 is found to be extremely effective in successfully cleaning substrates, but the requirement for the attachment and removal of the outer skin detracts from the overall efficiency of the process and the present applicants have, therefore, sought to address this aspect of the cleaning operation and to provide a process wherein this procedural step is no longer necessary. Thus, by providing for continuous circulation of the cleaning beads during the cleaning process, it has been found possible to dispense with the requirement for the provision of an outer skin.

Thus, in WO2011/098815, the present applicants provided an apparatus for use in the cleaning of soiled substrates, the apparatus comprising housing means having a first upper chamber with a rotatably mounted cylindrical cage mounted therein and a second lower chamber located beneath the cylindrical cage, and additionally comprising at least one recirculation means, access means, pumping means and a multiplicity of delivery means, wherein the rotatably mounted cylindrical cage comprises a drum having perforated side walls where up to 60% of the surface area of the side walls comprises perforations comprising holes having a diameter of no greater than 25.0 mm.

Although the apparatus disclosed in WO2010/094959, WO2011/064581 and particularly WO2011/098815 provided considerable improvements there remain several drawbacks associated with using an apparatus of this nature for the cleaning of soiled substrates with formulations comprising solid particulate cleaning material and wash water. In particular, the use of solid particulate material in such apparatus provides challenges associated with the transport of the solid particulate material throughout the cleaning process and storage of the material prior to commencing the cleaning operation and after its completion. Typically, the cleaning apparatus must therefore be adapted to accommodate both the storage of solid particulate material therein and to facilitate its transport so that it can be agitated with soiled substrates contained within a cleaning volume and separated from the washload at the end of the wash cycle. In order to accommodate effective agitation of the solid particulate material with soiled substrates and, ultimately, its separation from the washload, it is desirable to maximise the cleaning volume. Generally this aim cannot easily be attained without increasing the overall size or footprint of the apparatus.

The present invention seeks to provide a cleaning apparatus for use in the cleaning of soiled substrates with a solid particulate material that can ameliorate or overcome the above-noted problems associated with the prior art. Particularly, there is desired an apparatus and method for the cleaning of soiled substrates with a solid particulate cleaning material which can provide an enhanced cleaning capacity relative to the footprint of the apparatus. Further desired is an apparatus which can achieve good cleaning efficiency with a specific footprint size whilst further reducing the requirements for energy, water and detergents per unit quantity (e.g. weight) of soiled substrate washed. Further desired is an apparatus which improves the separation of said solid particulate material from the substrate after cleaning.

SUMMARY OF THE INVENTION

According to a first aspect of the present invention there is provided a cleaning apparatus for cleaning at least one soiled substrate with a multiplicity of solid particles, the apparatus comprising:

- an external casing defining the external perimeter of the apparatus, said external casing defining at least an upper internal volume and a lower internal volume;
- a perforate drum arranged in the upper internal volume and configured for rotation about a horizontal axis, for agitation of the at least one soiled substrate during a cleaning process;
- a partition sealingly dividing the upper internal volume from the lower internal volume, the partition including a collecting region configured to collect and retain wash liquor and solid particles of said multiplicity of solid particles released from the drum during a cleaning process;
- a recirculating arrangement configured to transfer particles of said multiplicity of solid particles from said collecting region to said drum;

wherein

- an internal surface of a wall of said external casing arranged substantially parallel to the axis of rotation of the drum is juxtaposed to said drum proximate the intersection of said internal surface with a plane forming a horizontal bisector of the drum;
- the collecting region has a maximum fill level for said wash liquor and solid particles, and
- the drum and the collecting region are positioned such that no part of the drum is present in any part of the collecting region which is at or below said maximum fill level.

As the cleaning apparatus of the present invention employs a multiplicity of solid particles to confer mechanical action on the soiled substrates and thereby elicit a cleaning effect, there is no requirement for the retention of a large volume of fluid within the drum, such as has been required by the prior art to enable mechanical action to occur. The invention can therefore avoid the retention of such large fluid volumes within the drum. The use of the solid particles in the cleaning operation to elicit mechanical action on the washload therefore permits a construction of the cleaning apparatus to facilitate a maximization of the cleaning volume that is precluded in conventional aqueous-based cleaning processes. It will be appreciated that, as used herein, the word "fluid" refers to liquids and not gases. The fluids preferably are water or wash liquor (which generally comprises water along with cleaning agents and suspended materials cleaned from the substrates).

The multiplicity of solid particles or solid particulate material as referred to herein is distinguished from, and should not be construed as being, a conventional washing powder (that is laundry detergent in powder form). Washing powder is generally soluble in the wash water and is included primarily for its detergent qualities. The washing powder is disposed of during the wash cycle since it is sent to drain in grey water along with removed soil. In contrast, a significant function of the multiplicity of solid particles referred to herein is a mechanical action on the substrate which enhances cleaning of the substrate.

Preferably, the drum and the collecting region are arranged and configured such that a lowermost part of the drum is spaced apart from said maximum fill level by a gap or spacing. In preferred configurations said gap or spacing can be not less than 1 mm.

Preferably, the cleaning apparatus is configured such that no part of the drum is present in the collecting region.

Preferably, said collecting region is shaped and dimensioned so that it can intercept wash liquor and/or solid particles which exit the drum and flow or fall downwardly from any part of the upper internal volume.

Preferably, the collecting region comprises a sump having one or more inclined surfaces configured to direct solid particles released from the drum during a cleaning process towards a lowermost part of the sump.

Preferably, the sump is arranged directly below the drum.

Preferably, said one or more inclined surfaces are defined by one or more inclined walls of the sump.

Preferably, said inclined walls have outer marginal edges which are arranged in confronting relation with adjacent side walls of the casing, a seal being disposed between each respective outer marginal edges and the adjacent side wall.

Preferably, the sump comprises a mouth for receiving said multiplicity of solid particles and said wash liquor, said mouth having a length dimension and a width dimension wherein said length dimension is equal to or greater than the length of the drum and wherein said width dimension is equal to or greater than the diameter of the drum.

Preferably, said mouth is bounded by said outer marginal edges of the inclined walls.

Preferably, the cleaning apparatus further comprises a door having an open condition and a closed condition, the door in its open condition providing access to the drum for insertion and removal of the substrate, and with the door in its closed condition wash liquor being able exit the upper internal volume only via the collecting region.

Preferably, the periphery of the drum, when viewed from above, is not greater than the mouth of the collecting portion.

Preferably, no structure is interposed between the drum and the casing and which contains, envelops or surrounds the drum.

Preferably, the recirculating arrangement includes a pumping device disposed in the lower internal volume and in fluid communication with the collecting region and with the drum.

Preferably, wash liquor can, in use, exit from the drum and contact one or more interior walls of the upper internal volume of the external casing.

Preferably, one or more of the interior walls of the upper internal volume of the external casing are waterproof.

Preferably, the ratio of the diameter of the drum to the spacing, along said plane forming a horizontal bisector of the drum, of the walls forming said external casing is at least 50:60, more preferably at least 52.5:60, even more preferably at least 54:60, and especially approximately 55:60. Preferably, the ratio of the drum diameter to the width of the external casing is at least 50:60, more preferably at least 52.5:60, even more preferably at least 54:60 and especially at least 55:60. Preferably, the width is measured along the plane forming a horizontal bisector of the drum.

Preferably, the ratio of the diameter of the drum to the spacing, along said plane forming a horizontal bisector of the drum, of the walls forming said external casing is not more than 59:60. In preferred embodiments, said ratio is not more than 58:60, in particular not more than 57:60. Preferably, the ratio of the drum diameter to the width of the external casing is not more than 59:60, more preferably not more than 58:60 and even more preferably not more than 57:60. Preferably, the width is measured along the plane forming a horizontal bisector of the drum.

Preferably, the perforations of the drum comprise holes having a diameter of no greater than about 5.0 mm or no greater than 3.0 mm.

Preferably, the drum has a capacity in the region of 10 to 7000 liters. Preferably, said drum has a capacity in the region of 10 to 700 liters.

Optionally, the drum has a capacity in the region of 30 to 150 liters.

Optionally, said drum has a capacity in the region of 125 to 150 liters.

Optionally said drum has a capacity in the region of 85 to 110 liters.

Optionally, the external casing has a length dimension of from about 50 cm to about 70 cm, a width dimension of from about 50 cm to about 70 cm and a height of from about 75 cm to about 95 cm. Said drum can have a capacity in the region of 85 to 110 liters.

Optionally the external casing can have an external length dimension of from about 70 cm to about 90 cm, an external width dimension of from about 50 cm to about 80 cm and an external height of from about 85 cm to about 115 cm. Said drum can have a capacity in the region of 125 to 150 liters.

It will be appreciated that the external casing may also be referred to as the "housing" of the apparatus.

Preferably, the cleaning apparatus is a domestic washing machine. A domestic washing machine can be a machine configured for location in a private dwelling such as a house or apartment.

Optionally, the cleaning apparatus can be a commercial washing machine. A commercial washing machine is preferably a machine configured for use in a commercial (non-domestic) laundry.

Preferably, the at least one soiled substrate comprises a textile material, in particular one or more garments, linens, napery, towels or the like.

Preferably, the multiplicity of solid particles comprises or consists of a multiplicity of polymeric particles.

The multiplicity of solid particles can comprise or can consist of a multiplicity of non-polymeric particles.

The multiplicity of solid particles can comprise or can consist of a mixture of polymeric solid particles and non-polymeric solid particles.

Preferably, the polymeric particles is selected from particles of polyalkenes, polyamides, polyesters, polysiloxanes, polyurethanes or copolymers thereof.

Optionally, the polymeric particles can comprise particles selected from particles of polyalkenes or copolymers thereof.

Preferably, the polymeric particles comprise particles of polyamide or polyester or copolymers thereof.

Preferably, the polyester particles comprise particles of polyethylene terephthalate or polybutylene terephthalate.

Preferably, the polyamide particles comprise particles of nylon. Preferably, said nylon comprises Nylon 6 or Nylon 6,6.

Preferably, the non-polymeric particles comprise particles of glass, silica, stone, wood, metals or ceramic materials.

Preferably, the polymeric particles have an average density of from about 0.5 to about 2.5 g/cm$^3$.

Preferably, the non-polymeric particles have an average density of from about 3.5 to about 12.0 g/cm$^3$.

Preferably, the multiplicity of solid particles is in the form of beads.

Preferably, the solid particles are reused one or more times for cleaning of said at least one soiled substrate in, with or by the cleaning apparatus. Preferably, the solid particles are reused for cleaning in, with or by the cleaning apparatus according to the first aspect of the present invention for at least two loads of soiled substrates, more preferably at least 10, even more preferably at least 50, yet more preferably at least 100 and especially at least 200 loads of soiled substrates. Typically the solid particles clean no more than 1,000 loads and more typically no more than 500 loads of soiled substrates.

According to a second aspect of the present invention there is provided a method for cleaning at least one soiled substrate comprising the treatment of the substrate with a multiplicity of solid particles using the cleaning apparatus according to the first aspect of the invention.

Preferably, the multiplicity of solid particles is reused. That is, the multiplicity of solid particles can be used again one or several times in a method or apparatus for cleaning at least one soiled substrate according to the present invention. Preferably, the method comprises introducing at least one additional cleaning agent into said drum. Preferably, the at least one cleaning agent comprises at least one detergent composition. Preferably, said at least one detergent composition comprises cleaning components and post-treatment components. Preferably, said cleaning components are selected from the group consisting of: surfactants, enzymes and bleach. Preferably, said post-treatment components are selected from the group consisting of: anti-redeposition additives, perfumes and optical brighteners.

Preferably, the method comprises introducing at least one additive into said drum wherein said at least one additive is selected from the group consisting of: builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and pigments.

BRIEF DESCRIPTION OF THE DRAWINGS

The invention will now be further illustrated by reference to the following drawings, wherein.

DETAILED DESCRIPTION OF THE INVENTION

Figure 2:
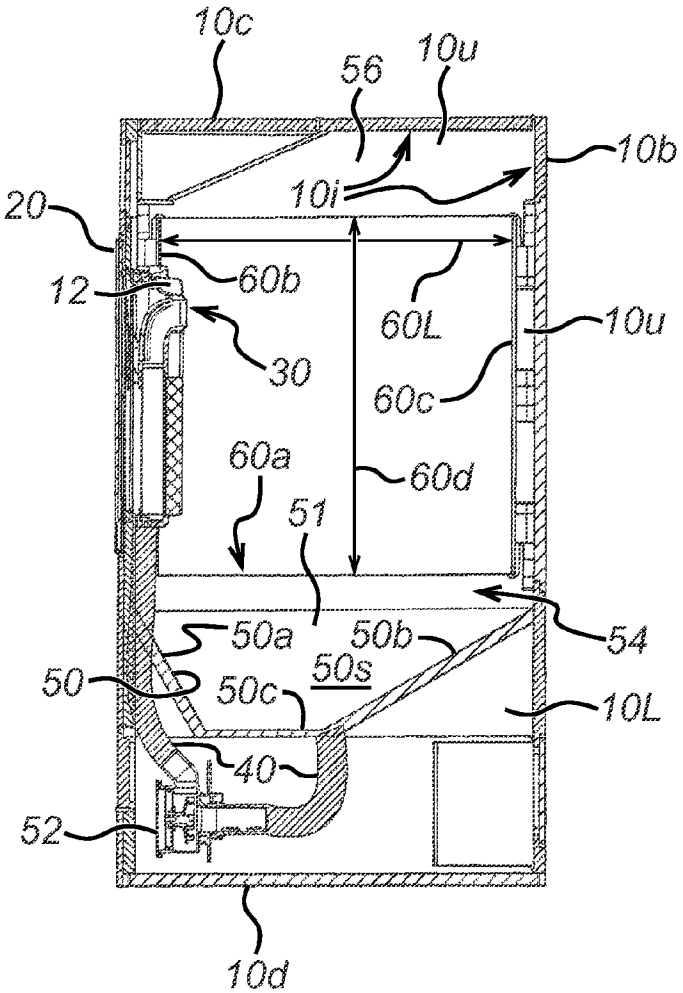
FIG. 2 shows a cross-sectional side view of the cleaning apparatus through section A-A of FIG. 1 according to the invention.
Figure 1:
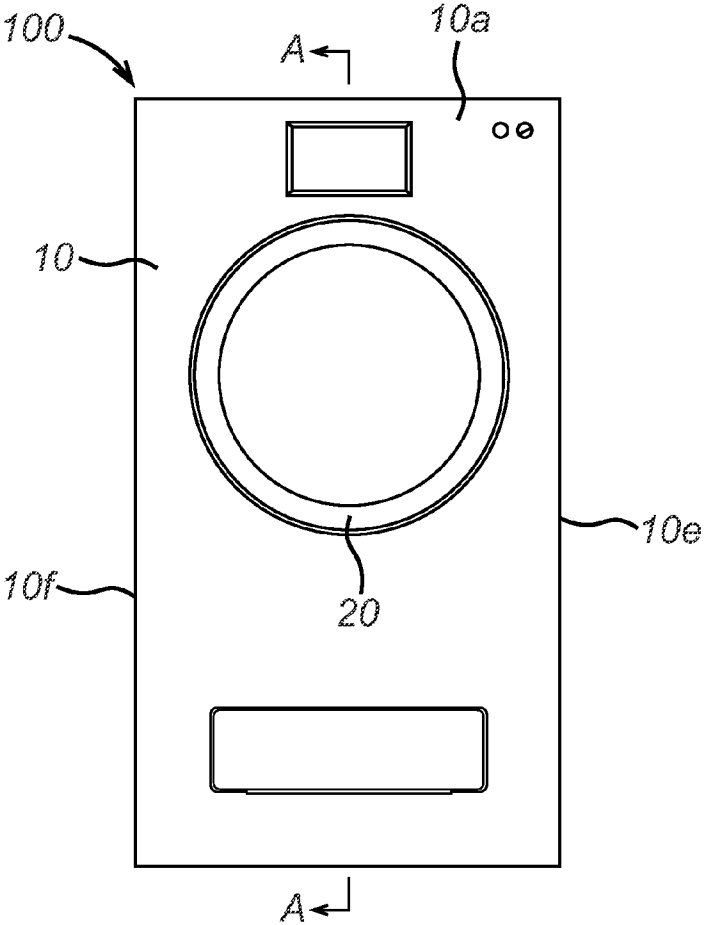
FIG. 1 shows a front view of a cleaning apparatus according to the invention.

The present applicant has addressed the issues associated with using a cleaning apparatus to clean soiled substrates with a solid particulate material and particularly the problems associated with maximizing the cleaning volume, such as a cylindrical cage or drum, within such a cleaning apparatus. Maximising the cleaning volume has the effect of improving the cleaning efficiency in terms of watts of power per kg of dry substrate.

Referring now to the drawings, an apparatus (100) according to the invention typically comprises a housing, cabinet or external casing (10) which can comprise a front wall (10*a*), rear wall (10*b*), top wall (10*c*), bottom wall (10*d*) and side walls (10*e*) and (10*f*). The external casing (10) further comprises an upper internal volume (10U) and a lower internal volume (10L).

A partition (50) divides the upper internal volume (10U) from the lower internal volume (10L). Partition (50) includes, or consists of, a collecting region (50S) in which solid particulate material and wash liquor can be collected and retained. Outer marginal edges of partition (50) can be arranged to sealingly contact or engage front wall (10*a*), rear wall (10*b*), and side walls (10*e*, 10*f*) such that the partition can resist or prevent passage of liquid from the upper internal volume (10U) to the lower internal volume (10L).

The apparatus (100) further includes a perforate drum or cage (60) defining a cleaning volume. The drum (60) can be in the form of a rotatably mounted cylindrical cage. In use of the apparatus (100) for cleaning a soiled substrate, the drum (60) contains the substrate(s) being cleaned. The drum (60) can be mounted for rotation about a horizontal axis and the substrate being cleaned can be brought into contact with solid particulate material, water and such other cleaning additives as may be desirable within the drum (60). Drum (60) can be mounted in the upper internal volume (10U) of the cabinet (10). The lower internal volume (10L) of the cabinet (10) can be located below the drum (60). The drum (60) comprises a length dimension (601) and a diameter (60*d*). Drum (60) can further comprise a cylindrical wall (60*a*) and opposed end walls (60*b*) and (60*c*).

The drum may be soft-mounted or hard-mounted. The term "soft-mounted" as used herein means that the drum is attached to the rest of the apparatus by means of a suspension system, such as springs and/or dampers. The term "hard-mounted" as used herein means that the drum is rigidly locked into position with respect to the external casing. Hard-mounting allows for even greater drum sizes as the drum cannot move relative to the casing, although requires a solid base (e.g. concrete) to which the apparatus can be affixed and/or a relatively stronger and more rigid apparatus. Soft-mounted drums are usually smaller than hard-mounted drums but do not require fixation to a base for installation.

Cylindrical wall (60*a*) of drum (60) can be perforate (perforations not shown in the drawings). The perforations can comprise holes, preferably having a diameter of from about 2 to about 25 mm and more preferably from about 2 to about 10 mm. Said perforations may comprise holes having a diameter of no greater than about 5 mm or no greater than about 3 mm. Opposed end walls are typically not perforate.

Said perforations can permit the egress of fluids and fine particulate materials of lesser diameter than the holes, but are adapted so as to prevent the egress of said solid particulate material. That is, in some cases, the maximum dimension of the solid particulate material is selected to be greater than the maximum dimension of the perforations of the drum (60).

Alternatively, said perforations can permit the egress of fluids and said solid particulate material. That is, in some cases, the maximum dimension of the solid particulate material can be selected to be less than the maximum dimension of the perforations of the drum (60), such that the solid particulate material can pass through said perforations.

Preferably, the cleaning apparatus (100) is configured so that accumulation of fluids to form a body or pool of fluid within the drum (60) can be avoided. Particularly, fluid can be prevented from filling or pooling within a lower portion of the drum during the wash cycle. This can be achieved because a flow path for fluid from the drum to the collecting region can always be present. The cleaning apparatus of the invention thus differs from front-loading conventional domestic washing machines which generally have a cleaning volume comprising a drum which further includes a tub or casing circumferentially surrounding the exterior cylindrical walls of the drum. The purpose of the tub is to store and retain wash liquor used in the cleaning operation. During a typical cleaning cycle for conventional washing machines, wash liquor is added by fluid delivery means so that a body or pool of fluid builds up and fills the lower portion of the drum due to the presence of the surrounding tub. The body of fluid can extend throughout the lower portion of the drum. Typically, said body of fluid is greater than 1 liter and can be in the region of about 4 liters up to about 10 liters depending on the size of the drum. It is inherent to conventional washing processes that the substrate(s) being cleaned is (are) immersed in a body of water contained in the drum (60). The large volume of fluid or wash liquor retained within the drum enables a degree of mechanical action to occur on the washload as the drum is rotated during the wash cycle.

Fluids cannot therefore fully drain from the drum during the cleaning operation for a conventional washing machine as they are retained by the surrounding tub. Fluid is, of course, drained from time to time from the tub during a conventional wash process by opening a tub drain valve or the like.

Since the drum (60) can be perforate, a flow path always exists for water or wash liquor to leave the drum (60). Water or wash liquor can, therefore, not be retained in the drum (60), other than such water or wash liquor as is taken up from time to time by the substrate being cleaned. In other words, fluids present in the drum (60) can always drip and flow out from the drum via the perforations in the drum (60) as the fluids are not prevented from draining out of the drum by any surrounding vessel. Small discrete quantities of fluid can reside on the surface of substrates being cleaned after fluids have been introduced to the interior of the drum (60) by fluid delivery means. However accumulation of fluid to form a retained body or pool of water within the drum (60) can be avoided. Depending on the rate of delivery of fluid (water or wash liquor) into the drum (60) some accumulation of fluid as a body in the drum (60) can possibly occur on a temporary, short term, basis. However, since such fluid can always have an exit path by flowing out of the drum (60) through the perforations of the drum, there can be no retention of a body of fluid with the drum (60). Typically, the fluid delivery means of the cleaning apparatus (100) can introduce only enough fluid to moisten the substrates contained within the drum (60). Any small volumes of fluid residing on the surface of the substrates in the drum (60) can be dispersed and can ultimately exit the drum (60) as it is rotated during a wash cycle.

It will be appreciated that the apparatus of the present does not require, or does not comprise, a plurality of pockets carried on the drum adapted to receive liquid to counterbalance unbalanced loads created by non-uniform distribution of material within the drum.

Advantageously, the cleaning apparatus of the invention can therefore be constructed such that a tub or casing surrounding the drum is no longer needed and is preferably absent from the apparatus. Stated differently, the apparatus of the present invention preferably includes no structure interposed between the drum (60) and the external casing (10) which fully surrounds, envelops or contains the drum (60). It is noted that the apparatus of the invention can include one or more structures interposed between the drum (60) and the casing (10), provided that such structures do not fully surround or enclose the drum (60) and in particular provided that such structures do not cause or allow a body of water or wash liquor to be retained within the drum (60).

Preferably, no such structure is interposed between the outer cylindrical surface (60*a*) of drum (60) and a wall (10*f*, 10*f*) of the casing (10) along, or immediately adjacent, a nominally horizontal bisecting plane of the drum (60). Expressed differently, on said nominally horizontal plane bisecting the drum 60, the external face of cylindrical wall 60*a* is juxtaposed to a wall (10*e*, 10*f*) of the casing (10), no feature or structure being present between the juxtaposed part of the cylindrical wall 60*a* and the casing wall (10*e*, 10*f*).

By excluding the presence of any intermediate or interposed structure or feature between the drum (60) and the closest parts of the casing side walls (10*e*, 10*f*), the size of the drum (60) relative to the size of the external casing (10) can be increased. It is noted in this respect that conventionally, the casing of washing machines is of cuboidal form, with the width dimension of the cuboid being smaller than the height dimension. Thus the side walls (10*e*), 10*f*) of the external casing can be the most closely positioned to the drum (60).

Increasing the volume of the drum (60) (by increasing its diameter relative to the size of the external casing (10)) can be advantageous in achieving an enhanced mechanical action of the solid particulate material on the substrate being cleaned, leading to enhanced cleaning performance. Such increase in the diameter of the drum (60) can also be advantageous for enhancing the separation of the solid particulate material from the substrate. The internal drum volume can therefore be increased without necessitating a corresponding increase of the cabinet or external casing size or footprint of the cleaning apparatus. The increased internal space within the cleaning apparatus can further facilitate the inclusion of other features that can aid or improve the collection, storage and/or transport of the solid particulate material employed in the apparatus.

The cleaning apparatus (100) can comprise a door (20) to allow access to the interior of the drum (60). The door can be mounted to a portion of the casing (10) and can be moveable between an open and a closed position. When the door (20) is moved to an open position, access is permitted to the inside of the drum (60). When the door (20) is moved to a closed position, upper internal volume (10U) of the cleaning apparatus (100) can be substantially sealed. Preferably, the drum (60) is mounted for rotation about a horizontal axis, hence said door (20) is preferably located in the front of the cleaning apparatus (100), thereby providing a front-loading facility.

Rotation of said rotatably mounted cylindrical cage or drum (60) can be effected by use of drive means, which typically can comprise electrical drive means, in the form of an electric motor. Operation of said drive means can be effected by control means which may be operated by a user.

The cleaning apparatus of the present invention may be a commercial washing machine. Typically, said rotatably mounted cylindrical drum or cage (60) is of the size which is to be found in most commercially available washing machines and tumble driers, and can have a capacity in the region of 10 to 7000 liters. A typical capacity for a domestic washing machine would be in the region of 30 to 150 liters whilst, for an industrial washer-extractor, capacities anywhere in the range of from 150 to 7000 liters are possible. A typical size in this range is that which is suitable for a 50 kg washload, wherein the drum has a volume of 450 to 650 liters and, in such cases, said drum (60) would generally comprise a cylinder with a diameter in the region of 75 to 120 cm, preferably from 90 to 110 cm, and a length of between 40 and 100 cm, preferably between 60 and 90 cm.

The cleaning apparatus of the present invention may be a domestic washing machine. Preferably, said domestic washing machine comprises a rotatably mounted cylindrical drum (60) having a capacity of from 30 to 150 liters, more preferably from 50 to 150 liters, even more preferably from 125 to 150 liters and especially from 85 to 110 liters. Generally the drum (60) of said domestic washing machine will be suitable for a 5 to 15 kg washload. For a domestic washing machine, the rotatably mounted cylindrical drum (60) preferably comprises a cylinder with a diameter in the region of 40 to 60 cm and a length in the region of 25 cm to 60 cm, more preferably a diameter in the region of about 50 cm to 60 cm and a length in the region of about 40 cm to about 50 cm and especially a diameter of about 55 cm and a length of about 44 cm. For domestic washing machines the drum (60) typically has 20 to 25 liters of volume per kg of washload to be cleaned.

Optionally, the housing or external casing (10) of the cleaning apparatus of the present invention can have a length dimension of from about 40 cm to about 120 cm, a width dimension of from about 40 cm to about 100 cm and a height of from about 70 cm to about 140 cm.

Optionally, the housing or external casing (10) of the cleaning apparatus of the present invention can have a length dimension of from about 50 cm to about 70 cm, a width dimension of from about 50 cm to about 70 cm and a height of from about 75 cm to about 95 cm. The housing or casing (10) of the cleaning apparatus can have a length dimension of about 60 cm, a width dimension of about 60 cm and a height of about 85 cm. In certain cases, the cleaning apparatus of the present invention can be comparable in size to a typical front-loading domestic washing machine commonly used in the Europe. The drum (60) mounted within said cleaning apparatus can have a capacity of from 85 to 110 liters and said drum (60) can have a capacity of about 105 liters. The maximum drum volume for a typical European front-loading domestic washing machine is in the region of 70 to 80 liters. Thus, preferably, the present invention provides a drum with a greater volume than conventional front-loading European domestic washing machines.

Optionally, the housing or external casing (10) of the cleaning apparatus of the present invention has a length dimension of from about 50 cm to about 100 cm, a width dimension of from about 40 cm to about 90 cm and a height of from about 70 cm to about 130 cm. The housing or external casing (10) can have a length dimension of from about 70 cm to about 90 cm, a width dimension of from about 50 cm to about 80 cm and a height of from about 85 cm to about 115 cm. In still further cases the housing or external casing (10) of the cleaning apparatus can have a length dimension of from about 77.5 cm to about 82.5 cm, a width dimension of from about 70 cm to about 75 cm and a height of from about 95 cm to about 100 cm. The housing or external casing (10) of the cleaning apparatus of the present invention can have a length dimension of about 71 cm (28 inches), a width dimension of about 80 cm (31.5 inches) and a height of about 96.5 cm (38 inches). The cleaning apparatus of the present invention can be comparable in size to a typical front-loading domestic washing machine commonly used in the USA. The drum (60) mounted within said cleaning apparatus may have a capacity of from 125 to 150 liters and said drum (60) can have a capacity of about 145 liters. The maximum drum volume for a typical front-loading domestic washing machine in the USA is in the region of 90 to 120 liters. Thus, the cleaning apparatus of the present invention can provide a drum with a greater volume than conventional front-loading domestic washing machines in the USA.

The cleaning apparatus (10) of the present invention is designed to operate in conjunction with soiled substrates and cleaning media comprising a solid particulate material which can be in the form of a multiplicity of polymeric or non-polymeric particles. These polymeric or non-polymeric particles can be efficiently circulated to promote effective cleaning and the cleaning apparatus (10), therefore, can include circulation means. Thus, the inner surface of the cylindrical side walls of said rotatably mounted cylindrical drum (60) can comprise a multiplicity of spaced apart elongated protrusions affixed essentially perpendicularly to said inner surface. Said protrusions can additionally comprise air amplifiers which are typically driven pneumatically and are adapted so as to promote circulation of a current of air within said drum (60). Typically said cleaning apparatus (10) can comprise from 3 to 10, preferably 4, of said protrusions, which are commonly referred to as lifters.

Figure 4:
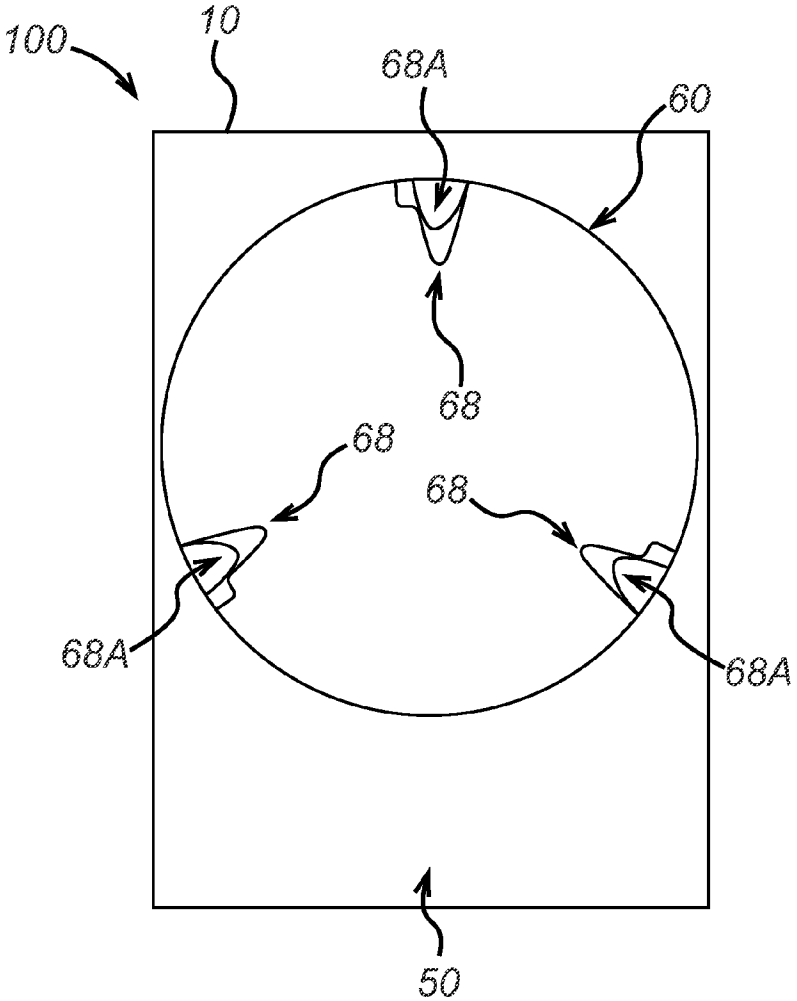
FIG. 4 shows a further cross-sectional front view of a cleaning apparatus including the drum according to the present invention.
Figure 3:
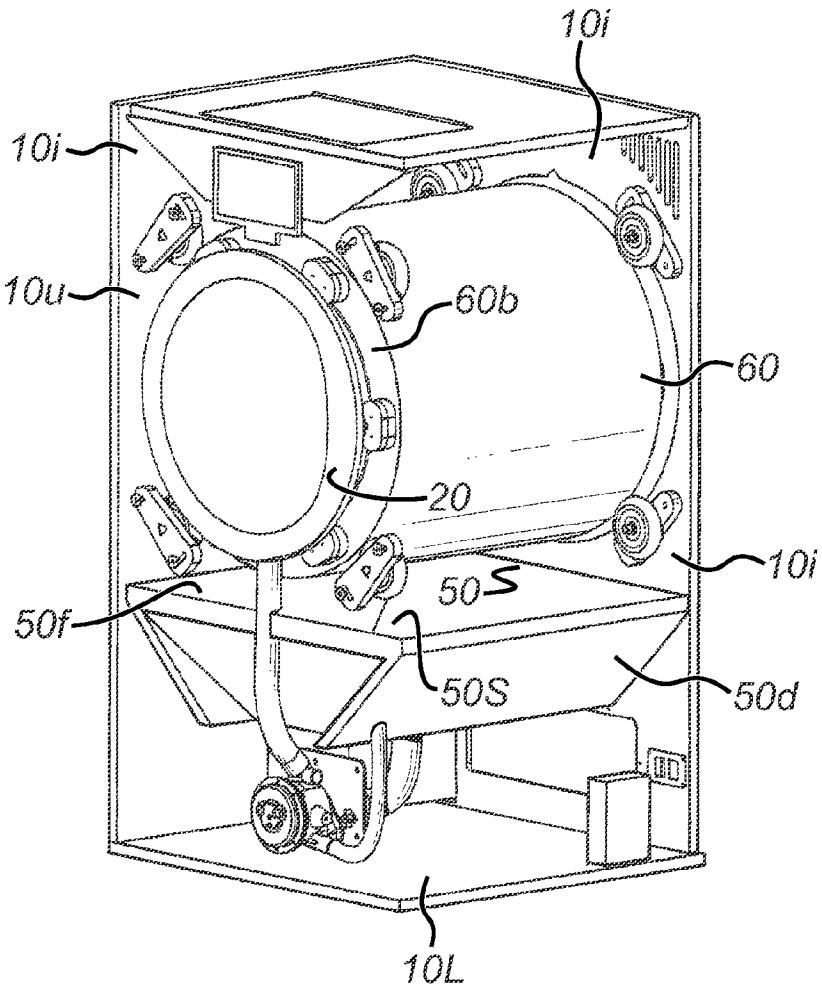
FIG. 3 shows an isometric view of a cleaning apparatus according to the present invention with two of the walls of the external casing removed.

The cleaning apparatus (10) can comprise lifters which can collect the solid particulate material and transfer it out of the drum (60), such as to a lower portion of the upper internal volume. Particularly said lifters can facilitate transportation of the solid particulate material to the collecting region or sump (50S). Referring now to FIG. 4, the lifters (68) can comprise collecting and transferring means (68A) in the form of a plurality of compartments. The lifters (68) can be located at equidistant intervals on the inner circumferential surface of the rotatably mounted drum (60).

The lifters (68) can comprise a first aperture allowing ingress of solid particulate material into a capturing compartment and a second aperture allowing transfer of said solid particulate material. The dimensions of the apertures can be selected in line with the dimensions of the solid particulate material, so as to allow efficient ingress and transfer thereof. Preferably, the capturing compartment is moveable between first and second positions. Such movement can be determined by the rotational position of the drum, for example. In a first position, the capturing compartment can be portioned to receive the solid particulate material from the drum (60) and to retain the solid particulate material in the capturing compartment. In the second position, the solid particulate material can be released from the capturing compartment through the second aperture, so that the capturing compartment can be emptied.

In operation, agitation of the substrate being cleaned can be provided by rotation of said rotatably mounted cylindrical drum (60) of said cleaning apparatus (10). However, additional agitating means may also be provided, in order to facilitate the efficient removal of residual solid particulate material at the conclusion of the cleaning operation. As an example, said additional agitating means can comprise an air jet.

The cleaning apparatus (10) according to the invention may comprise at least one delivery means. The delivery means can facilitate the entry of wash liquor constituents (notably water and/or cleaning agents) directly (that is, otherwise than by way of the sump (50S) and pumping means (52) as herein described below) to the rotatably mounted cylindrical drum (60) as required. The cleaning apparatus (10) can comprise a multiplicity of delivery means. Suitable delivery means can include one or more spraying means such as spray nozzle (12) as illustrated in FIG. 2. The delivery means can deliver, for example, water, one or more cleaning agents or water in combination with said one or more cleaning agents. The delivery means of the cleaning apparatus (10) can be adapted to first add water to moisten the substrate before commencing the wash cycle. The delivery means can be adapted to add one or more cleaning agents during the wash cycle. The delivery means can be mounted on a portion of the door (20).

As described herein, "wash liquor" pertains to an aqueous medium used in the cleaning apparatus and can comprise water or water when combined with at least one cleaning agent such as a detergent composition and/or any further additives as detailed further hereinbelow.

The composition of the wash liquor may depend at any given time on the point which has been reached in the cleaning cycle for the soiled substrate using the apparatus of the invention. Thus, for example, at the start of the cleaning cycle, the wash liquor can be water. At later point in the cleaning cycle the wash liquor can include detergent and/or one of more of the below mentioned additives. During a cleaning stage of the cleaning cycle, the wash liquor can include suspended soil removed from the substrate.

The cleaning apparatus (100) may include standard plumbing features, in addition to said multiplicity of delivery means, by virtue of which at least water and, optionally, cleaning agents such as surfactants, can be circulated prior to their introduction to the rotatably mounted cylindrical drum (60) and during the wash cycle.

The cleaning apparatus (10) can additionally comprise means for circulating air within said housing (80), and for adjusting the temperature and humidity therein. Said means can typically include, for example, a recirculating fan, an air heater, a water atomiser and/or a steam generator. Additionally, sensing means can also be provided for determining, inter alia, the temperature and humidity levels within the cleaning apparatus (10), and for communicating this information to control means which can be worked by an operative.

Apparatus (100) can comprise a collecting region or sump (50S) which can be formed as a part or portion of partition (50). The sump (50S) can be disposed below the drum (60) for the collection of fluids and/or solid particulate material that exit the drum (60). Sump (50S) can be in the form of a collecting vessel or container arranged below the drum (60). The sump (50S) can have an open mouth at an upper part thereof. Solid particulate material and/or fluid (water, wash liquor) can fall from the drum (60) directly into the sump (50S). Thus, there is suitably no intervening structure or component which obstructs the passage of fluid and/or solid particulate material falling from the drum (60) into the sump (50S).

The sump (50S) can be defined by one or more inclined walls extending inwardly from one or more interior surfaces of the walls (10*a*, 10*b*, 10*e*, 10*f*) of the casing (10). The one or more walls of the sump (50S) can sealingly join or engage the one or more interior surfaces or walls (10*a*, 10*b*, 10*e*, 10*f*) of the cabinet (10). The sump (50S) can be defined by a front wall (50*a*), a rear wall (50*b*), a first sidewall (50*d*), a second sidewall (50*f*) and a floor (50*c*). One or more areas of the sump (50S) particularly said one or more of the walls, can be inclined so as to direct fluids and/or solid particulate material towards a lowermost part of the sump (50S) such as the floor. (50*c*).

Sump (50S) can serve to collect and retain a portion of (or all of) the solid particulate material used in the apparatus (100) of the invention. The collected solid particulate material may be transferred immediately to the drum (60) for further use in a cleaning process, or may be retained in the sump (50S) for a period of time, such as between cleaning procedures.

The open mouth of sump (50S) can be defined by the respective upper marginal edge portions of the front wall (50*a*), rear wall (50*b*), first sidewall (50*d*) and second sidewall (50*f*) of the sump (50S). The mouth of the sump can have a length dimension and a width dimension wherein said length dimension is equal to or greater than the length of the drum (601) and wherein said width dimension is equal to or greater than the diameter of the drum (60*d*). Preferably, when viewed from above, the periphery or outline of the drum (60) is either not greater than the mouth or opening of the sump (50S), or is surrounded by the mouth or opening of the sump (50S).

Thus, the open mouth of sump (50S) as defined by the respective upper marginal edge portions of the front wall (50*a*), rear wall (50*b*), first sidewall (50*d*) and second sidewall (50*f*) of the sump (50S) suitably extends to the interior surfaces or walls of the external casing or cabinet, and particularly wherein there are substantially no horizontal or substantially horizontal surfaces between said respective upper marginal edge portions and said interior surfaces or walls of the external casing. In particular, when viewed from above, suitably there are substantially none such horizontal or substantially horizontal surfaces (i.e. surfaces between said respective upper marginal edge portions and said interior surfaces or walls of the external casing) which lie directly or vertically beneath the drum. Such horizontal or substantially horizontal surfaces may interfere with the return of the beads released from the drum during a cleaning cycle back to the drum via the collecting region. The term "horizontal" has the meaning conventional in the art, and refers to a surface which is horizontal in the environment in which the apparatus is positioned, and typically this will mean that said surface is parallel to the surface on which the apparatus is located and/or perpendicular to at least one sidewall (10*a*, 10*b*, 10*e*, 10*f*) of the external casing (10) and/or parallel with the top wall (10*c*) and/or bottom wall (10*d*) of the external casing (10). The term "substantially no horizontal or substantially horizontal surfaces" is intended to exclude the presence of one or more horizontal surface(s) of dimensions sufficiently large to retain solid particulate material thereupon during use of the apparatus. Similarly the term "substantially horizontal" refers to a surface which is sufficiently close in angle to the horizontal plane (i.e. insufficiently inclined) that it retains solid particulate material thereupon during use of the apparatus.

The sump (50S) can function as an area for receiving and retaining the solid particulate material and can further contain water and/or one or more cleaning agents. During the wash cycle, water and/or one or more cleaning agents can be added from the delivery means into the drum (60) and fluids can exit via perforations in the walls of the drum (60) and fall into the sump (50). The solid particulate material may be transferred from the drum (60) to the sump (50S). For example, the lifters (68) can facilitate transfer of the solid particulate material to the sump (50S). In further cases, the solid particulate material can fall from or be transferred from a low portion of cylindrical wall (60*a*) of the drum. During the course of a wash cycle, the contents of the sump (50S) can comprise water in combination with one or more cleaning agents and the solid particulate material. The total volume of fluids and solid particulate material in the sump (50S) can vary from time to time during a cleaning process using the apparatus of the invention. For example, the rate at which fluid (water, wash liquor) is transferred from the sum (50S) to the drum (60) may be different at different times in the cleaning process. The same can be true with respect to the transfer of the solid particulate material from the sump (50S) to the drum (60), and its return from the drum (60) to the sump (50S). Also the quantity of fluid used in different wash procedures (such as for different types of substrate) can be different, again leading to variations in the total volume of fluid in the sump (50S). Stated differently, the volume of fluid and the quantity of solid particulate material contained in the sump (50S) are each dynamic.

Preferably, the drum (60) is spaced with respect to the sump (50S) such that no part of the drum (60) can contact fluid and/or solid particulate material contained in the sump (50S).

Preferably, the sump (50S) has a maximum fill level for fluid and/or solid particulate material. The quantity of fluid and/or solid particulate material cannot then exceed the predetermined maximum fill level. Preferably, the drum (60) is arranged with respect to the sump (50S) such that no part of the drum (60) extends into the sump beyond said maximum fill level. In this way, although a portion of the drum (60) can be arranged to enter the sump (50S), no part of the drum (60) can contact fluid and/or solid particulate material contained in the sump (50S).

Preferably, the drum (60) and the sump (50S) is arranged such that no part of the drum is present in the sump (50S).

Preferably, the sump (50S) has a maximum fill level as described above and the drum (60) is positioned relative to the sump (50S) such that a gap or spacing is always present between an outer surface of the drum (60) nearest to the maximum fill level and the maximum fill level. Preferably, said gap can be at least 5 mm, such as at least 2 mm and in particular at least 1 mm.

It is noted that at times during a cleaning process, such as during a spin cycle to extract water or wash liquor from the substrate being cleaned, the drum (60) can be rotated at high speeds. It can be possible that, if the drum (60) is arranged too closely with respect to the fluid and/or solid particulate material contained in the sump (50S), fluid and/or solid particulate material may become entrained and lifted from the sump (50S). Accordingly, providing a sufficient gap between the outer surface of the drum (60) and a maximum fill level of the sump (50S) is typically advantageous.

The apparatus (100) can include an electronic controller configured to control operation of the apparatus. Such control may be effected in response to user/operator inputs from time to time, such as to initiate a cleaning cycle. The electronic controller can comprise a processor and a memory containing logical instructions executed by the processor. Execution of such instructions can control one or more aspects of the operation of the apparatus.

One such aspect which can be controlled by the controller through execution of appropriate logical instructions by the processor can be control of the amount of fluid and/or solid particulate material in the sump (50S) at any given time. In specific arrangements, the controller is configured to control the entry of fluid (such as water) into the apparatus (and specifically into the sump) and the egress of fluid from the sump (50S), such as transfer of fluid to the drum (60) or sending wash liquor to drain during or after a cleaning cycle. The control can also be configured to control the rate and/or timing of the transfer of solid particulate material from the sump (50S) to the drum (60). Such control can be effected by control of the operation of the pumping device (52), for example.

The primary route of egress of fluid (water, wash liquor) from the drum (60) is downwardly through perforations at a lower part of the drum (60). However, during rotation of the drum (60), and notably when the drum is rotated at higher speeds in a "spin cycle" (for extraction of fluid from the substrate), fluid may exit the drum (60) in substantially any direction through the perforations. The same can be true for the solid particulate material if the relative sizes of the particles and the perforations are such that the particles can pass through the perforations. Thus, as the drum (60) rotates, fluids, that may include one or more cleaning agents, can exit the drum (60) through the perforations and contact one or more interior surfaces of the apparatus (100) in the upper internal volume (10U). Typically, one or more interior surfaces can comprise one or more interior walls (10*i*) of the external casing (10) located in the upper internal volume (10U) of the apparatus (100). For the avoidance of doubt, it is not an essential requirement that fluid exiting the drum (60) should contact any internal wall (10*i*) of the external casing (10). However, depending, for example, on the exit speed and direction of the fluid leaving the drum (60) contact of the fluid with a wall (10*i*) is sometimes possible.

In view of the above considerations, preferably, the upper internal volume (10U) can be made watertight, in the sense that fluid (water or wash liquor) can exit the upper internal volume (10U) only by way of the sump (50S). Preferably, the upper internal volume (10U) can be sealed (when the door (30) is in its closed position). One or more ventilation arrangements may be provided to allow a pathway for air to enter or exit the (otherwise sealed) upper internal volume 10U, such ventilation arrangements not, however, providing an exit pathway for any substantial amount of fluid from the upper internal chamber (10*a*).

Preferably, the one or more interior walls (10*i*) of the upper internal volume (10U) of the external casing (10) is/are waterproof. Thus, said walls (10*i*) can be composed of a waterproof material or can comprise a waterproof coating. Preferably, the upper internal volume 10U of the casing (10) comprises a waterproof material or skin lining its interior. If said fluids exit the drum (60) during rotation thereof and contact said one or more interior walls (10*i*), the fluids can flow down the interior walls of the casing (10) and into the sump (50S). The sump (50S) can be dimensioned to intercept and collect fluids flowing and/or falling from upper parts of upper internal volume 10U.

The sump (50S) can further comprise heating means allowing its contents to be raised to a preferred temperature for use in the cleaning operation. The heating means can comprise one or more heater pads attached to the outer surface of the sump (50S).

Typically, the sump (50S) contains said solid particulate material prior to first use of the cleaning apparatus (10). In operation, water can be added to the solid particulate material in the sump (50S). When a threshold or desired volume of water is present in the sump (50S), the water and solid particulate material can be pumped from the sump (50S) and into the rotatably mounted cylindrical drum (60).

The cleaning apparatus (100) can comprise a pumping device (52) to pump wash liquor and the solid particulate material. The pumping device (52) can be adapted to pump wash liquor in combination with the solid particulate material from the sump (50S) along a pathway for introduction to the drum (60). In some embodiments the pumping device (52) can be located within a lower internal volume (10L) of the cabinet (10). In some embodiments the pumping device (52) can be positioned below the sump (50S). Alternatively, the pumping means (52) can be positioned within the sump (50S) or can be mounted on a portion of the sump (50S).

Said pathway for introduction of said solid particulate material to the drum (60) can comprise ducting (40) connected to said pumping device (52). The ducting (40) can be connected to the sump (50S). The wash liquor and the solid particulate material can be pumped from the floor (50*c*) of the sump (50S) to the drum (60).

The cleaning apparatus (10) can thus comprise means to recirculate the wash liquor and the solid particulate material. The solid particulate material can be recirculated from the lower internal volume (10L) of the casing (10) to the drum. Recirculation of the solid particulate material enables its re-use in the cleaning operation. In some embodiments, the solid particulate cleaning material can be recirculated along a path between the sump (50S) and the rotatably mounted cylindrical drum (60). To facilitate transport of said solid particulate material along said recirculation path, the cleaning apparatus (10) can utilise ducting (40) extending from the lower internal volume (10L) of the cabinet (10). The pumping device (52) can be adapted to pump said solid particulate material and wash liquor along said recirculation path via the ducting (40).

The cleaning apparatus (10) can further comprise a separating device. Water or wash liquor pumped from the sump (50S) can be separated from the solid particulate material by the action of the separating device prior to entry into the drum (60). The amount of wash liquor entering the drum (60) with the solid particulate material can therefore be limited or regulated. The door (20) of the apparatus can include a separating device. The solid particulate material can enter the drum (60) via an entry port (30) proximate the door (20). Any water or wash liquor which does not enter the drum (60) can be returned to the sump (50S) via a suitable drain.

The cleaning apparatus of the present invention preferably comprises the multiplicity of solid particles.

The cleaning apparatus according to the invention is principally designed for use in the cleaning of substrates comprising a textile material, in particular one or more garments, linens, napery, towels or the like. The cleaning apparatus of the invention has been shown to be particularly successful in achieving efficient cleaning of textile fibres which may, for example, comprise either natural fibres, such as cotton, wool, silk or man-made and synthetic textile fibres, for example nylon 6,6, polyester, cellulose acetate, or fibre blends thereof.

The solid particulate material for use in the invention can comprise a multiplicity of polymeric particles or a multiplicity of non-polymeric particles. Preferably, the solid particulate material comprises a multiplicity of polymeric particles. The solid particulate material can comprise a mixture of polymeric particles and non-polymeric particles. Optionally, the solid particulate material can comprise a multiplicity of non-polymeric particles. Thus, the solid particulate material can comprise exclusively polymeric particles, exclusively non-polymeric particles or mixtures of polymeric and non-polymeric particles.

The polymeric particles or non-polymeric particles can be of such a shape and size as to allow for good flowability and intimate contact with the substrate and particularly with textile fibre. A variety of shapes of particles can be used, such as cylindrical, spherical, ellipsoidal or cuboid; appropriate cross-sectional shapes can be employed including, for example, annular ring, dog-bone and circular. In some embodiments, the particles can comprise generally cylindrical, ellipsoidal or spherical beads.

The polymeric particles or non-polymeric particles can have smooth or irregular surface structures and can be of solid, porous or hollow structure or construction.

Preferably, the polymeric particles are of such a size as to have an average mass of about 1 mg to about 150 mg, more preferably of about 1 mg to about 80 mg, especially of about 1 mg to about 50 mg, more especially of about 10 mg to about 40 mg and most especially of about 12 mg to about 30 mg.

The non-polymeric particles can be of such a size as to have an average mass of about 1 mg to about 3 g, or of about 10 mg to about 1 g or of about 25 mg to about 200 mg.

The polymeric or non-polymeric particles can have a surface area of 10 $mm^2$ to 120 $mm^2$, of 15 $mm^2$ to 50 $mm^2$ or of 20 $mm^2$ to 40 $mm^2$.

Preferably, the polymeric particles have an average density in the range of from about 0.5 to about 2.5 $g/cm^3$, more preferably from about 0.55 to about 2.0 $g/cm^3$ and especially from about 0.6 to about 1.9 $g/cm^3$. For the avoidance of doubt it is noted that herein "average density" refers to the density of a particle as such and not to bulk density of a mass or body of particles.

Preferably, the non-polymeric particles have an average density greater than the polymeric particles. Preferably, the non-polymeric particles have an average density in the range of about 3.5 to about 12.0 $g/cm^3$, more preferably of about 5.0 to about 10.0 $g/cm^3$ and especially of about 6.0 to about 9.0 $g/cm^3$.

Preferably, the average volume of the polymeric and non-polymeric particles are in the range of 5 to 275 $mm^3$, more preferably in the range of 8 to 140 $mm^3$ and especially in the range of 10 to 120 $mm^3$.

The polymeric or non-polymeric particles can be substantially cylindrical, substantially ellipsoidal or substantially spherical in shape.

Preferably, the cylindrical particles can be of oval cross section. For cylindrical particles, the major cross section axis length, a, can be in the region of from 2.0 to 6.0 mm. Preferably, a can be in the region of from 2.2 to 5.0 mm and more preferably in the region of from 2.4 mm to 4.5 mm. The minor cross section axis length, b, can be in the region of from 1.3 to 5.0 mm. Preferably, b can be in the region of from 1.5 to 4.0 mm and more preferably b can be in the region of from 1.7 mm to 3.5 mm. For an oval cross section, a>b. Preferably, the length of the cylindrical particles, h, can be in the range of from about 1.5 mm to about 6 mm, more preferably the length h can be from about 1.7 mm to about 5.0 mm, even more preferably the length h of the particle can be from about 2.0 mm to about 4.5 mm. The ratio h/b is typically in the range of from about 0.5 to about 10.

The cylindrical particles can be of circular cross section. The typical cross section diameter, $d_c$, can be in the region of from 1.3 to 6.0 mm, more typically in the region of from 1.5 to 5.0 mm and even more typically in the region of from 1.7 mm to 4.5 mm. Preferably, the length of such particles, $h_c$, is in the range of from about 1.5 mm to about 6 mm, more preferably from about 1.7 mm to about 5.0 mm and even more preferably from about 2.0 mm to about 4.5 mm. The ratio $h_c/d_c$ is typically be in the range of from 0.5-10.

Optionally, the particles are generally spherical in shape (but not a perfect sphere) preferably having a particle diameter, $d_s$, in the region of from 2.0 to 8.0 mm, more preferably in the region of from 2.2 to 5.5 mm and especially in the region of from about 2.4 mm to about 5.0 mm.

Optionally, the particles can be perfectly spherical in shape preferably having a particle diameter, $d_{ps}$, in the region of from 2.0 to 8.0 mm, more preferably in the region of from 3.0 to 7.0 mm and especially in the region of from about 4.0 mm to about 6.5 mm.

Preferably, the polymeric particles comprise polyalkenes such as polyethylene and polypropylene, polyamides, polyesters, polysiloxanes or polyurethanes. Preferably, said polymeric particles comprise polyamide or polyester particles, particularly particles of nylon, polyethylene terephthalate or polybutylene terephthalate, typically in the form of beads. Said polyamides and polyesters can be particularly effective for aqueous stain/soil removal, whilst polyalkenes can be especially useful for the removal of oil-based stains.

Various nylon or polyester homo- or co-polymers can be used including, but not limited to, Nylon 6, Nylon 6,6, polyethylene terephthalate and polybutylene terephthalate. Preferably the nylon is Nylon 6,6 having a molecular weight in the region of from about 5000 to about 30000 Daltons, such as from about 10000 to about 20000 Daltons, or such as from about 15000 to about 16000 Daltons. Useful polyesters can have a molecular weight corresponding to an intrinsic viscosity measurement in the range of from about 0.3 to about 1.5 dl/g, as measured by a solution technique such as ASTM D-4603.

Optionally, copolymers of the above polymeric materials can be employed for the purposes of the invention. Specifically, the properties of the polymeric materials can be tailored to specific requirements by the inclusion of monomeric units which confer particular properties on the copolymer. Thus, the copolymers can be adapted to attract particular staining materials by including monomer units in the polymer chain which, inter alia, are ionically charged, or include polar moieties or unsaturated organic groups. Examples of such groups can include, for example, acid or amino groups, or salts thereof, or pendant alkenyl groups.

Optionally, the polymeric particles can comprise foamed polymers. Alternatively, the polymeric particles can comprise unfoamed polymers. The polymeric particles can comprise polymers which are linear, branched or crosslinked.

Preferably, the non-polymeric particles comprise particles of glass, silica, stone, wood, or any of a variety of metals or ceramic materials. Suitable metals include, but are not limited to, zinc, titanium, chromium, manganese, iron, cobalt, nickel, copper, tungsten, aluminium and tin, and alloys thereof. Suitable ceramics include, but are not limited to, alumina, zirconia, tungsten carbide, silicon carbide and silicon nitride.

The present invention provides a method for cleaning a soiled substrate using the cleaning apparatus as herein described wherein the method can comprise the treatment of the substrate with a formulation comprising said solid particulate material and wash liquor.

In order to provide additional lubrication to the cleaning apparatus and thereby improve the transport properties within the system, wash liquor, which can be water, is added. Thus, more efficient transfer of the cleaning material to the substrate is facilitated, and removal of soiling and stains from the substrate occurs more readily. The solid particulate material can thus elicit a cleaning effect on the substrate and water can simply aid the transport of said solid particulate material. Optionally, the soiled substrate may be moistened by wetting with mains or tap water prior to loading into the cleaning apparatus of the invention. Wetting of the substrate within the apparatus of the invention is however preferable. In any event, water can be added to the drum (60) of the invention such that the washing treatment is carried out so as to achieve a wash water or wash liquor to substrate ratio in the drum (60) which, typically is between 5:1 and 0.1:1 w/w, more typically between 2.5:1 and 0.1:1 w/w, and most typically between 2.0:1 and 0.8:1. By means of example, particularly favourable results have been achieved at ratios such as 1.75:1, 1.5:1, 1.2:1 and 1.1:1. Most conveniently, the required amount of water can be introduced into the drum (60) of the apparatus according to the invention after loading of the soiled substrate into said drum.

Typically, the method of the invention envisages the cleaning of a soiled substrate by the treatment of a moistened substrate with only solid particulate material (i.e. in the absence of any further additives) optionally in other embodiments the formulation employed can additionally comprise at least one cleaning agent. The at least one cleaning agent can include at least one detergent composition. Preferably, said at least one cleaning agent is introduced into the drum of the cleaning apparatus before or following commencement of the wash cycle. Optionally, said particles comprised in said solid particulate material can be coated with said at least one cleaning agent.

The principal components of the detergent composition can comprise cleaning components and post-treatment components. Preferably, the cleaning components comprise surfactants, enzymes and bleach, whilst the post-treatment components can include, for example, anti-redeposition additives, perfumes and optical brighteners.

However, the formulations for use with the apparatus of the invention can further optionally include one or more other additives such as, for example builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and/or pigments.

Examples of suitable surfactants that can be included in the detergent composition can be selected from non-ionic and/or anionic and/or cationic surfactants and/or ampholytic and/or zwitterionic and/or semi-polar nonionic surfactants. The surfactant can typically be present at a level of from about 0.1%, from about 1%, or even from about 5% by weight of the cleaning compositions to about 99.9%, to about 80%, to about 35%, or even to about 30% by weight of the cleaning compositions.

The detergent composition can include one or more detergent enzymes which provide cleaning performance and/or fabric care benefits. Examples of suitable enzymes include, but are not limited to, hemicellulases, peroxidases, proteases, other cellulases, other xylanases, lipases, phospholipases, esterases, cutinases, pectinases, keratanases, reductases, oxidases, phenoloxidases, lipoxygenases, lignin-ases, pullulanases, tannases, pentosanases, malanases, [beta]-glucanases, arabinosidases, hyaluronidase, chondroitinase, laccase, and amylases, or mixtures thereof. A typical combination can comprise a mixture of enzymes such as protease, lipase, cutinase and/or cellulase in conjunction with amylase.

Optionally, enzyme stabilisers can also be included amongst the cleaning components. In this regard, enzymes for use in detergents may be stabilised by various techniques, for example by the incorporation of water-soluble sources of calcium and/or magnesium ions in the compositions.

The detergent composition can include one or more bleach compounds and associated activators. Examples of such bleach compounds include, but are not limited to, peroxygen compounds, including hydrogen peroxide, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N,N'-phthaloylaminoperoxycaproic acid and amidoperoxyacid. Bleach activators include, but are not limited to, carboxylic acid esters such as tetraacetylethylenediamine and sodium nonanoyloxybenzene sulphonate.

Suitable builders can be included as additives and include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxym ethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

The additives can also optionally contain one or more copper, iron and/or manganese chelating agents and/or one or more dye transfer inhibiting agents.

Suitable polymeric dye transfer inhibiting agents for use in the detergent composition include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Optionally, the detergent composition can also contain dispersants. Suitable water-soluble organic materials are the homo- or co-polymeric acids or their salts, in which the polycarboxylic acid may comprise at least two carboxyl radicals separated from each other by not more than two carbon atoms.

Said anti-redeposition additives that can be included in the detergent composition are physico-chemical in their action and include, for example, materials such as polyethylene glycol, polyacrylates and carboxy methyl cellulose.

Optionally, the detergent composition can also contain perfumes. Suitable perfumes are generally multi-component organic chemical formulations which can contain alcohols, ketones, aldehydes, esters, ethers and nitrile alkenes, and mixtures thereof. Commercially available compounds offering sufficient substantivity to provide residual fragrance include Galaxolide (1,3,4,6,7,8-hexahydro-4,6,6,7,8,8-hexamethylcyclopenta(g)-2-benzopyran), Lyral (3- and 4-(4-hydroxy-4-methyl-pentyl) cyclohexene-1-carboxaldehyde and Ambroxan ((3aR,5aS,9aS,9bR)-3a,6,6,9a-tetramethyl-2,4,5,5a,7,8,9,9b-octahydro-1H-benzo[e][1] benzofuran). One example of a commercially available fully formulated perfume is Amour Japonais supplied by Symrise® AG.

Suitable optical brighteners that can be used in the detergent composition fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds include, but are not limited to, 4,4'-bis[[6-anilino-4(methylamino)-1,3,5-triazin-2-yl]amino]stilbene-2,2'-disulphonic acid, 4,4'-bis[[6-anilino-4-[(2-hydroxyethyl)methylamino]-1,3,5-triazin-2-yl]amino]stilbene-2,2'-disulphonic acid, disodium salt, 4,4'-Bis[[2-anilino-4-[bis(2-hydroxyethyl)amino]-1,3,5-triazin-6-yl]amino]stilbene-2,2'-disulphonic acid, disodium salt, 4,4'-bis[(4,6-dianilino-1,3,5-triazin-2-yl)amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulphonic acid, disodium salt, and 2,5-bis(benzoxazol-2-yl) thiophene.

Said above components can be used either alone or in a desired combination and can be added at appropriate stages during the washing cycle in order to maximise their effects.

Preferably, the ratio of solid particulate material to substrate is generally in the range of from about 0.1:1 to about 30:1 w/w, more preferably in the range of from about 0.1:1 to about 20:1 w/w, even more preferably in the range of from about 0.1:1 to about 15:1 w/w, especially the range of from about 0.1:1 to about 10:1 w/w, more especially in the region of from about 0.5:1 to about 5:1 w/w, yet more especially is between about 1:1 and about 3:1 w/w and most especially around 2:1 w/w. Thus, for example, for the cleaning of 5 g of fabric, 10 g of polymeric or non-polymeric particles could be employed in one embodiment of the invention.

The apparatus and the method of the present invention can be used for either small or large scale batchwise processes and finds application in both domestic and industrial cleaning processes. The present invention can be applied to domestic washing machines and processes.

In a typical wash cycle using the cleaning apparatus (100) of the invention, soiled substrates are first placed into the rotatably mounted cylindrical drum (60). Then, an appropriate amount of wash liquor (water, together with any additional cleaning agent) can be added to said rotatably mounted cylindrical drum (60) via the delivery means (12). Water may be pre-mixed with the cleaning agent prior to its introduction into the drum (60). Typically, water can be added first in order to suitably wet or moisten the substrate before further introducing any cleaning agent. Optionally, the water and the cleaning agent can be heated. Following the introduction of water and any optional cleaning agents, the wash cycle can commence by rotation of the drum (60). The solid particulate material and (further) wash liquor residing in the sump (50), which optionally can be heated to a desired temperature, can then be pumped upwardly along ducting (40) and into the drum (60) via the door (20) through entry port (30). The amount of wash liquor entering the drum (60) with the solid particulate material can be limited by the action of a separating device in the door prior to entry to the drum (60).

During the course of agitation by rotation of the drum (60), water including any cleaning agents can fall through the perforations in the drum (60), and into the sump (50S). In addition, rotation of the drum (60) can cause fluids to exit from the perforations of the drum (60) in directions other than a downward direction. Depending on the speed and direction in which the fluid exits the drum (60) (which can depend, for example, on the speed of rotation of the drum (60)) the fluid can fall onto an outer surface of the drum and flow (directly or indirectly) to a lower part of the said outer surface before falling to the sump (50S), or, the fluid can fall directly to the sump (50S), such as through a gap existing between the drum (60) and a surface (10*i*) of a wall (e.g. 10*e*, 10*f*) of the casing (10), or, the fluid can impact a wall surface (10*i*) and flow down said surface to the sump (50S). Other flow paths can be possible for fluid exiting the drum (60), depending on such other components as may be arranged within the upper internal volume (10U) and their particular location. Such components may require a waterproof coating or housing, depending on their purpose or construction. By way of example, one such component could be the internal side of a user-operated control panel. Such a control panel could include electrical or electronic parts which can require protection from ingress of moisture.

A quantity of the solid particulate material can also be transferred through a lower wall portion (60*a*) of the drum (60) and into the sump (50S). Optionally, lifters disposed on the inner circumferential surface of the drum (60) can collect the solid particulate material as the drum (60) rotates and transfer the solid particulate material to the sump (50S). The inwardly inclined walls of the sump (50S) can direct fluids and solid particulate material towards a lower-most part of the sump (50S) such as the floor (50*c*). Pumping means (52) can again pump wash liquor in combination with the solid particulate material from the sump (50S) upwardly via ducting (40) and into the drum (60) via the door (20). Consequently, additional solid particulate material can enter into the drum (60) during the wash cycle. Furthermore, solid particulate material used in the cleaning operation and returned to the sump (50S) can be reintroduced into the drum (60) and can therefore be re-used in either a single wash cycle or subsequent wash cycles. Wash liquor pumped upwardly from the sump (50S) with the solid particulate material and which does not enter the rotatably mounted drum (60) can be returned to the sump (50) via a suitable drain.

The cleaning apparatus (100) can perform a wash cycle which in some respects is similar to a standard washing machine. Thus the drum (60) can rotate at between 30 and 40 rpm for several revolutions in one direction, then rotating a similar number of rotations in the opposite direction. This sequence can be repeated for up to about 60 minutes. During this period, solid particulate material can be introduced and reintroduced to the drum (60) from the sump (50S) in the manner as described above.

As previously noted, the apparatus and method of the invention can find particular application in the cleaning of textile fibres. The conditions employed in such a cleaning system do, however, allow the use of significantly reduced temperatures from those which typically apply to the conventional wet cleaning of textile fabrics and, as a consequence, offer significant environmental and economic benefits. Thus, typical procedures and conditions for the wash cycle require that fabrics are generally treated using the apparatus of the invention at, for example, temperatures of between 5 and 95° C. for a duration of between about 5 and 120 minutes in a substantially sealed system. Thereafter, additional time may be required for the completion of the rinsing and any further stages of the overall process. Generally, the total duration of the entire cycle can typically be in the region of about 1 hour. The operating temperatures for the cleaning methods using the apparatus of the invention can be in the range of from about 10 to about 60° C. or from about 15 to about 40° C.

The extent of cleaning and stain removal achieved with fabrics treated by the method of the invention is seen to be very good, with particularly outstanding results being achieved in respect of hydrophobic stains and aqueous stains and soiling, which are often difficult to remove. The energy requirement, the total volume of water used, and the detergent consumption when using the cleaning apparatus of the invention are all significantly lower than those levels associated with the use of conventional aqueous washing procedures, again offering significant advantages in terms of cost and environmental benefits.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A cleaning apparatus for cleaning at least one soiled substrate with a multiplicity of solid particles, the apparatus comprising:

an external casing defining the external perimeter of the apparatus, said external casing defining at least an upper internal volume and a lower internal volume;

a perforate drum arranged in the upper internal volume and configured for rotation about a horizontal axis, for agitation of the at least one soiled substrate during a cleaning process;

a partition sealingly dividing the upper internal volume from the lower internal volume, the partition including a collecting region configured to collect and retain wash liquor and solid particles of said multiplicity of solid particles released from the drum during a cleaning process;

a recirculating arrangement configured to transfer solid particles of said multiplicity of solid particles from said collecting region to said drum;

wherein an internal surface of a wall of said external casing arranged substantially parallel to the axis of rotation of the drum is juxtaposed to said drum proximate the intersection of said internal surface with a plane forming a horizontal bisector of the drum;

the collecting region has a maximum fill level for said wash liquor and solid particles, the drum and the collecting region are positioned such that no part of the drum is present in any part of the collecting region which is at or below said maximum fill level; and no structure is interposed between the drum and the casing and which envelops the drum.

2. The cleaning apparatus of claim 1 wherein the drum and the collecting region are arranged and configured such that a lowermost part of the drum is spaced apart from said maximum fill level by a gap or spacing.

3. The cleaning apparatus as claimed in claim 1 wherein no part of the drum is present in the collecting region.

4. The cleaning apparatus of claim 1 wherein said collecting region is shaped and dimensioned so that it can intercept wash liquor and/or solid particles which exit the drum and flow or fall downwardly from any part of the upper internal volume.

5. The cleaning apparatus of claim 1, wherein the collecting region comprises a sump having one or more inclined surfaces configured to direct solid particles released from the drum during a cleaning process towards a lowermost part of the sump.

6. The cleaning apparatus as claimed in claim 5 wherein the sump is arranged directly below the drum.

7. The cleaning apparatus as claimed in claim 5 wherein said one or more inclined surfaces are defined by one or more inclined walls of the sump.

8. The cleaning apparatus as claimed in claim 7 wherein said inclined walls have outer marginal edges which are arranged in confronting relation with adjacent side walls of the casing, a seal being disposed between each respective outer marginal edge and the adjacent side wall.

9. The cleaning apparatus of claim 5, wherein the sump comprises a mouth for receiving said solid particles and said wash liquor, said mouth having a length dimension and a width dimension, wherein said length dimension is equal to or greater than the length of the drum and wherein said width dimension is equal to or greater than the diameter of the drum.

10. The cleaning apparatus as claimed in claim 9 wherein said mouth is bounded by outer marginal edges of the inclined walls.

11. The cleaning apparatus as claimed in claim 9 wherein the periphery of the drum, when viewed from above, is not greater than the mouth.

12. The cleaning apparatus as claimed in claim 9 wherein the mouth of the sump as defined by respective upper marginal edge portions of a front wall, rear wall, first sidewall and second sidewall of the sump extends to interior surfaces or walls of the external casing.

13. The cleaning apparatus of claim 1, further comprising a door having an open condition and a closed condition, the door in its open condition providing access to the drum for insertion and removal of the substrate and wherein when the door is in its closed condition wash liquor can exit the upper internal volume only via the collecting region.

14. The cleaning apparatus of claim 1, wherein said apparatus further comprises a separating device for separating water or wash liquor from a stream comprising water or wash liquor and solid particles, wherein said stream comprising water or wash liquor and solid particles is pumped from a sump such that said water or wash liquor is separated from said stream comprising water or wash liquor and solid particles prior to entry of said stream into the drum.

15. The cleaning apparatus of claim 1, wherein said apparatus does not comprise a plurality of pockets carried on the drum adapted to receive liquid to counterbalance unbalanced loads created by non-uniform distribution of material within the drum.

16. The cleaning apparatus of claim 1, wherein said drum is soft-mounted or hard-mounted.

17. The cleaning apparatus of claim 1, wherein the recirculating arrangement includes a pumping device disposed in the lower internal volume and in fluid communication with the collecting region and with the drum.

18. The cleaning apparatus of claim 1, wherein, in use, wash liquor can exit from the drum and contact one or more interior walls of the upper internal volume of the external casing.

19. The cleaning apparatus of claim 1, wherein one or more of the interior walls of the upper internal volume of the external casing are waterproof.

20. The cleaning apparatus of claim 1, wherein the ratio of the diameter of the drum to a spacing, along said plane forming a horizontal bisector of the drum, of the walls forming said external casing is at least 50:60, and/or wherein the ratio of the diameter of the drum to the spacing along said plane forming a horizontal bisector of the drum of the walls forming said external casing is not more than 59:60.

21. The cleaning apparatus of claim 1, wherein the drum comprises holes having a diameter of no greater than 5.0 mm.

22. The cleaning apparatus of claim 1, wherein the drum has a capacity in the region of 10 to 7000 liters.

23. The cleaning apparatus of claim 1, wherein the drum has a capacity in the region of 30 to 150 liters.

24. The cleaning apparatus of claim 1, wherein the external casing has a length dimension of from about 50 cm to about 70 cm, a width dimension of from about 50 cm to about 70 cm and a height of from about 75 cm to about 95 cm and wherein said drum has a capacity in the region of 85 to 110 liters; or wherein the external casing has an external length dimension of from about 70 cm to about 90 cm, an external width dimension of from about 50 cm to about 80 cm and an external height of from about 85 cm to about 115 cm and wherein said drum has a capacity in the region of 125 to 150 liters.

25. The cleaning apparatus of claim 1, wherein the cleaning apparatus is a domestic washing machine or a commercial washing machine.

26. The cleaning apparatus of claim 1, wherein the cleaning apparatus further comprises a multiplicity of solid particles.

27. The cleaning apparatus of claim 1, wherein the at least one soiled substrate comprises a textile material.

28. The cleaning apparatus of claim 26, wherein the multiplicity of solid particles comprise or consist of a multiplicity of polymeric particles.

29. The cleaning apparatus of claim 26, wherein the multiplicity of solid particles is in the form of beads.

30. The cleaning apparatus of claim 26, wherein the multiplicity of solid particles are reused one or more times for cleaning of at least one soiled substrate in, with or by the cleaning apparatus.

31. A method for cleaning at least one soiled substrate comprising the treatment of the substrate with a multiplicity of solid particles using the cleaning apparatus of claim 1.

32. A method according to claim 31 wherein the multiplicity of solid particles are reused for cleaning at least two wash-loads of soiled substrate(s).

33. The cleaning apparatus as claimed in claim 12, wherein there are substantially no horizontal or substantially horizontal surfaces between said respective upper marginal edge portions and said interior surfaces or walls of the external casing.

* * * * *